US010287963B2

(12) United States Patent
Tsuno et al.

(10) Patent No.: US 10,287,963 B2
(45) Date of Patent: May 14, 2019

(54) OUTBOARD MOTOR

(71) Applicant: YAMAHA HATSUDOKI KABUSHIKI KAISHA, Iwata-shi, Shizuoka (JP)

(72) Inventors: Kenichiro Tsuno, Shizuoka (JP); Hitoshi Motose, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 20 days.

(21) Appl. No.: 15/641,371

(22) Filed: Jul. 5, 2017

(65) Prior Publication Data

US 2018/0051619 A1 Feb. 22, 2018

(30) Foreign Application Priority Data

Aug. 22, 2016 (JP) ..... 2016-162200

(51) Int. Cl.

| | |
|---|---|
| ***F01P 3/20*** | (2006.01) |
| ***B63H 20/00*** | (2006.01) |
| ***B63H 20/28*** | (2006.01) |
| ***B63H 20/32*** | (2006.01) |
| ***F02B 61/04*** | (2006.01) |
| ***F02B 67/00*** | (2006.01) |
| ***F02M 35/16*** | (2006.01) |

(52) U.S. Cl.

CPC ..... *F01P 3/202* (2013.01); *B63H 20/001* (2013.01); *B63H 20/285* (2013.01); *B63H 20/32* (2013.01); *F02B 61/045* (2013.01); *F02B 67/00* (2013.01); *F02M 35/167* (2013.01); *B63H 20/28* (2013.01); *F01P 2050/12* (2013.01)

(58) Field of Classification Search

CPC .... F01P 3/202; F01P 2050/12; F02M 35/167; F02B 61/045; F02B 67/00; B63H 20/32; B63H 20/001; B63H 20/285; B63H 20/28

See application file for complete search history.

(56) References Cited

U.S. PATENT DOCUMENTS

| | | | | |
|---|---|---|---|---|
| 5,996,561 | A | 12/1999 | Watanabe | |
| 6,645,021 | B1 | 11/2003 | Kawai et al. | |
| 2003/0089327 | A1 | 5/2003 | Ochiai et al. | |
| 2010/0003873 | A1 * | 1/2010 | Konakawa ..... | B63H 20/245 440/89 H |

(Continued)

FOREIGN PATENT DOCUMENTS

| | | |
|---|---|---|
| EP | 1 092 849 A2 | 4/2001 |
| JP | 10-184337 A | 7/1998 |

(Continued)

*Primary Examiner* — Sizo B Vilakazi

(74) *Attorney, Agent, or Firm* — Keating and Bennett, LLP

(57) ABSTRACT

An outboard motor includes an engine, an engine cover with which the engine is covered, an intake pipe disposed between an outer surface of the engine and an inner surface of the engine cover, and a battery. The engine includes a piston that reciprocates rectilinearly and a crankshaft that rotates around a crankshaft axis extending in an up-down direction. The intake pipe is connected to a first outer surface of the engine along the crankshaft axis, and supplies air to the engine. The battery is disposed between a second outer surface of the engine, which is different than the first outer surface, and the inner surface of the engine cover.

18 Claims, 10 Drawing Sheets

(56) References Cited

U.S. PATENT DOCUMENTS

| | | | | |
|---|---|---|---|---|
| 2010/0022148 | A1* | 1/2010 | Konakawa | F01N 3/02 440/89 H |
| 2010/0031931 | A1 | 2/2010 | Hirose | |
| 2010/0056001 | A1* | 3/2010 | Konakawa | F01N 3/10 440/89 H |
| 2010/0056002 | A1* | 3/2010 | Konakawa | F01N 3/10 440/89 H |
| 2010/0059008 | A1* | 3/2010 | Konakawa | B63H 20/32 123/184.48 |
| 2010/0248562 | A1* | 9/2010 | Daikoku | B63H 20/30 440/3 |
| 2015/0133007 | A1* | 5/2015 | Saruwatari | B63H 20/28 440/88 L |
| 2015/0133008 | A1* | 5/2015 | Maekawa | F01M 13/04 440/88 L |

FOREIGN PATENT DOCUMENTS

| | | | |
|---|---|---|---|
| JP | 2001-107800 | A | 4/2001 |
| JP | 2005-153727 | A | 6/2005 |
| JP | 2006-151010 | A | 6/2006 |
| JP | 2010-38129 | A | 2/2010 |

* cited by examiner

OUTBOARD MOTOR

BACKGROUND OF THE INVENTION

1. Field of the Invention

The present invention relates to an outboard motor.

2. Description of the Related Art

An outboard motor disclosed in Japanese Patent Application Publication No. 2006-151010 includes an engine and an engine cover with which the engine is covered. Electric power used by the outboard motor is supplied from a battery disposed in a hull. The battery is connected to the outboard motor through cables and an ignition switch. The ignition switch supplies the electric power of the battery to auxiliary devices, such as an ECU (electronic control unit) and a starter motor that are included in the outboard motor, in accordance with a position that has been selected.

The present inventor has considered that a space in which the battery is disposed in the hull and a cable through which the battery and the outboard motor are connected together are able to be reduced by mounting the battery on the outboard motor. However, in order to mount the battery on the outboard motor, attention is required so that the battery is fully protected and so that the battery does not significantly affect engine performance.

SUMMARY OF THE INVENTION

In order to overcome the previously unrecognized and unsolved challenges described above, a preferred embodiment of the present invention provides an outboard motor including an engine, an engine cover that covers the engine, an intake pipe disposed between an outer surface of the engine and an inner surface of the engine cover, and a battery. The engine includes a piston that reciprocates rectilinearly and a crankshaft that rotates around a crankshaft axis extending in an up-down direction. The intake pipe is connected to a first outer surface extending along the crankshaft axis in the outer surface of the engine, and supplies air to the engine. The battery is disposed between a second outer surface of the engine, which is different than the first outer surface, and the inner surface of the engine cover.

According to this preferred embodiment, the battery is disposed between a second outer surface, which is different than the first outer surface to which the intake pipe is connected, and the inner surface of the engine cover. As a result, the size of the intake pipe, the shape thereof, and the disposition thereof that affect the performance of the engine are not restricted by the battery. Therefore, it is possible to mount the battery on the outboard motor so that any influence on the performance of the engine is small or negligible. The disposition of the battery inside the engine cover makes it possible to fully protect the battery from the influence of the surrounding environment.

In a preferred embodiment of the present invention, the second outer surface may extend along the crankshaft axis. In this case, likewise, it is possible to mount the battery on the outboard motor so that the battery is fully protected and does not affect the performance of the engine.

In a preferred embodiment of the present invention, the engine preferably includes an engine body that includes a cylinder containing the piston and a crankcase containing the crankshaft, and the second outer surface is a surface of the crankcase.

According to this preferred embodiment, it is possible to significantly reduce or prevent the performance of the battery from being reduced due to heat generated in the cylinder because the battery is spaced apart from the cylinder. In other words, it is possible to significantly reduce or prevent any influence on the battery by the engine.

In a preferred embodiment of the present invention, the second outer surface is preferably located such that the engine body is sandwiched between the first outer surface and the second outer surface.

According to this preferred embodiment, the engine body is positioned between the second outer surface and the first outer surface. Therefore, the battery disposed at the second outer surface does not exert a significant influence on the performance of the engine.

In a preferred embodiment of the present invention, the second outer surface is preferably located at a more rearward position than the crankshaft axis. In this case, likewise, it is possible to mount the battery on the outboard motor so that the battery is fully protected and so that a significant influence is not exerted on the performance of the engine.

In a preferred embodiment of the present invention, the second outer surface preferably extends along a direction along which the piston reciprocates.

According to this preferred embodiment, the battery disposed at the second outer surface does not easily receive vibrations caused by the movement of the piston. This makes it possible to mount the battery on the outboard motor so that any influence on the performance of the engine is small or negligible, and makes it possible to significantly reduce or prevent the durability of the battery from being reduced due to the vibrations, and makes it possible to significantly reduce or prevent the connection between the battery and an electrical component from being broken due to the vibrations.

In a preferred embodiment of the present invention, the engine includes a cylinder head to which the intake pipe is connected, and the second outer surface preferably includes an upper surface of the cylinder head. In this case, likewise, it is possible to mount the battery on the outboard motor so that the battery is fully protected and so that a significant influence is not exerted on the performance of the engine.

In a preferred embodiment of the present invention, the outboard motor includes a fuel supply that is disposed between the outer surface of the engine and the inner surface of the engine cover and that supplies fuel to the engine, and the battery is preferably spaced apart from the fuel supply.

According to this preferred embodiment, it is possible to mount the battery without exerting a significant influence on the fuel supply.

In a preferred embodiment of the present invention, the battery preferably faces the surface of the inner surface of the engine cover that faces the second outer surface.

According to this preferred embodiment, it is possible to further reduce or prevent any influence exerted by the battery on the engine because the battery is spaced apart from the engine. Additionally, it becomes difficult for vibrations of the engine to be transmitted to the battery. This makes it possible to significantly reduce or prevent the durability of the battery from being reduced due to the vibrations of the engine, and makes it possible to significantly reduce or prevent the connection between the battery and an electrical component from being broken due to the vibrations.

In a preferred embodiment of the present invention, the battery is preferably located on the second outer surface.

According to this preferred embodiment, the battery is fixed to the engine, and therefore the position of the battery is stabilized.

In a preferred embodiment of the present invention, an installation surface that faces the second outer surface in the battery preferably extends along the second outer surface.

According to this preferred embodiment, the battery does not easily exert an influence on the engine because the installation surface extends along the second outer surface. Additionally, the position of the battery becomes even more stable.

In a preferred embodiment of the present invention, the battery is preferably box-shaped or substantially box-shaped, and the installation surface is located on one outer surface of the battery, and may be wider than other outer surfaces of the battery.

According to this preferred embodiment, the position of the battery is made even more stable because the installation surface, which is wider than the other outer surfaces of the battery, extends along the second outer surface.

In a preferred embodiment of the present invention, the outboard motor preferably includes a mount that is used to mount the battery on the engine. The mount is disposed at an outer surface, among the other outer surfaces of the battery, that is continuous with an edge of the installation surface.

According to this preferred embodiment, the battery is attached to the engine by the mount at the outer surface of the battery, and, as a result, the battery is attachable thereto in a manner in which any influence exerted on the engine is small, and the position of the battery becomes even more stable.

In a preferred embodiment of the present invention, the outboard motor preferably includes a battery cover that covers the battery and includes a first flow passage through which cooling water flows.

According to this preferred embodiment, it is possible to cool the battery by cooling water that flows through the first flow passage, and hence it is possible to significantly reduce or prevent a reduction in the performance of the battery resulting from an increase in temperature. Additionally, cooling of the battery makes it possible to avoid heat stagnating around the engine caused by the battery, and hence makes it possible to reduce any influence exerted by the battery on the engine.

In a preferred embodiment of the present invention, the outboard motor preferably includes a second flow passage through which cooling water that is used to cool the engine flows, and the first flow passage branches from the second flow passage.

According to this preferred embodiment, it is possible to cool the battery using cooling water by which the engine is cooled. This makes it possible to make the arrangement simpler than in a case which uses cooling water to exclusively cool the battery, and hence makes it possible to reduce costs.

In a preferred embodiment of the present invention, the engine cover preferably includes an outside-air intake port to take in outside air, and the battery faces the outside-air intake port.

According to this preferred embodiment, it is possible to cool the battery with outside air taken in from the outside-air intake port, and hence it is possible to significantly reduce or prevent a reduction in the performance of the battery resulting from an increase in temperature.

In a preferred embodiment of the present invention, the battery is preferably disposed directly under the outside-air intake port.

According to this preferred embodiment, it is possible to directly blow outside air taken in from the outside-air intake port to the battery, and hence it is possible to facilitate the cooling of the battery with the outside air. This makes it possible to further reduce or prevent a reduction in the performance of the battery resulting from an increase in temperature.

In a preferred embodiment of the present invention, the engine preferably includes a plurality of cylinders arranged in the up-down direction. In this case, likewise, it is possible to mount the battery on the outboard motor so that the battery is fully protected and so that a significant influence is not exerted on the performance of the engine.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention will be hereinafter described in detail with reference to the accompanying drawings.

First Preferred Embodiment

Figure 1:
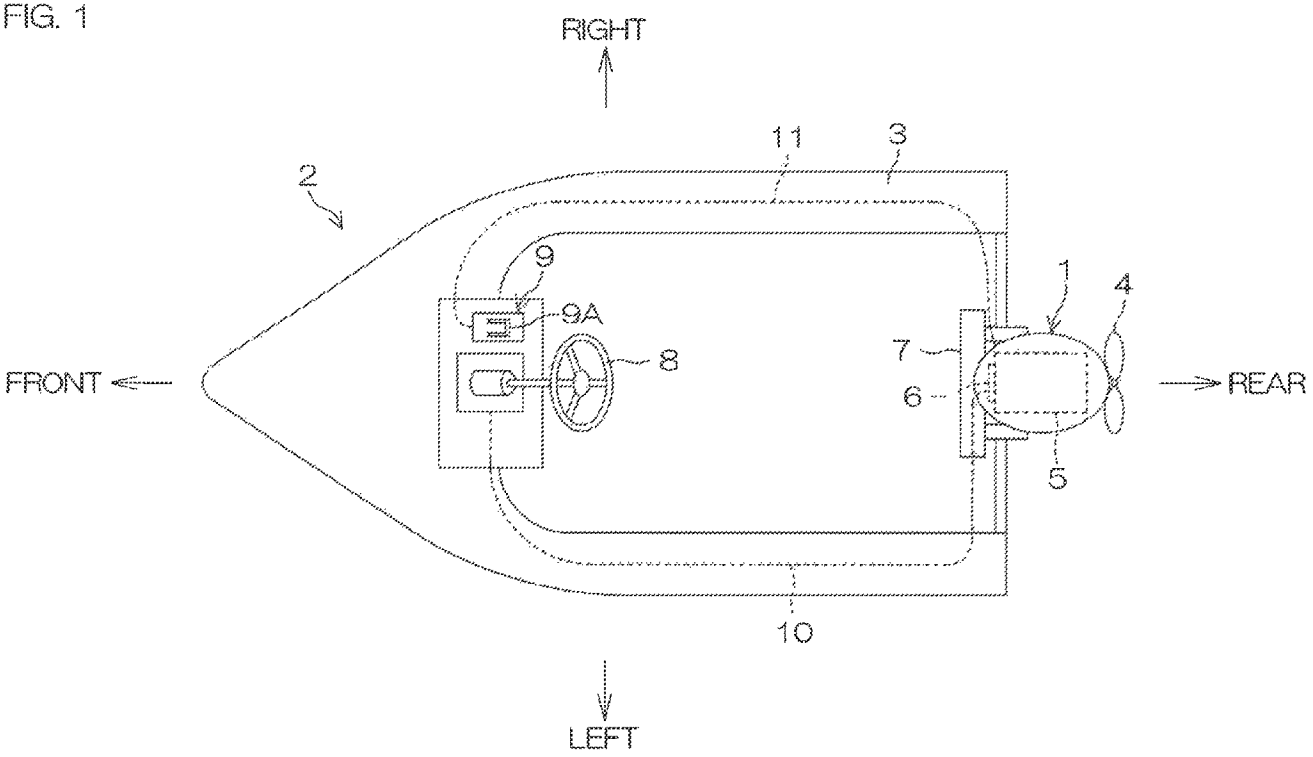
FIG. 1 is a schematic plan view showing an arrangement of a vessel that includes an outboard motor according to a preferred embodiment of the present invention.

FIG. 1 is a schematic plan view showing an arrangement of a vessel 2 that includes an outboard motor 1 according to a preferred embodiment of the present invention. The vessel 2 also includes a hull 3. The outboard motor 1 is attached to a rear of the hull 3. The outboard motor 1 generates a propulsive force that propels the hull 3. The outboard motor 1 includes an engine 5 that rotates a propeller 4 and an ECU (electronic control unit) 6 that controls the outboard motor 1. In relation to the outboard motor 1, a steering apparatus 7 is provided to steer the outboard motor 1 in the left-right direction. The hull 3 includes a steering wheel 8 and a remote controller 9.

The steering wheel 8 is connected to the ECU 6 through a harness 10. When the steering wheel 8 is operated by a vessel operator, the ECU 6 controls the steering apparatus 7. As a result, the steering apparatus 7 steers the outboard motor 1 in the left-right direction, and therefore the vessel 2 is steered by the direction of a propulsive force applied to the hull 3 changing in the left-right direction.

The remote controller 9 is preferably mechanically joined to the outboard motor 1 by an operation cable 11. When the vessel operator operates an operation lever 9A provided in the remote controller 9, its operating force is transmitted to the outboard motor 1 by the operation cable 11. As a result, the shift position of the outboard motor 1 changes. In other words, the operation of the operation lever 9A makes it possible to change the direction of the propulsive force of the outboard motor 1 between the forward direction and the reverse direction, and makes it possible to bring about a neutral state in which the power of the engine 5 is not transmitted to the propeller 4. The operating force of the operation lever 9A is transmitted to a throttle valve (not shown) of the engine 5. As a result, the throttle opening degree of the throttle valve changes by operating the operation lever 9A, and the output of the engine 5 changes.

Figure 2:
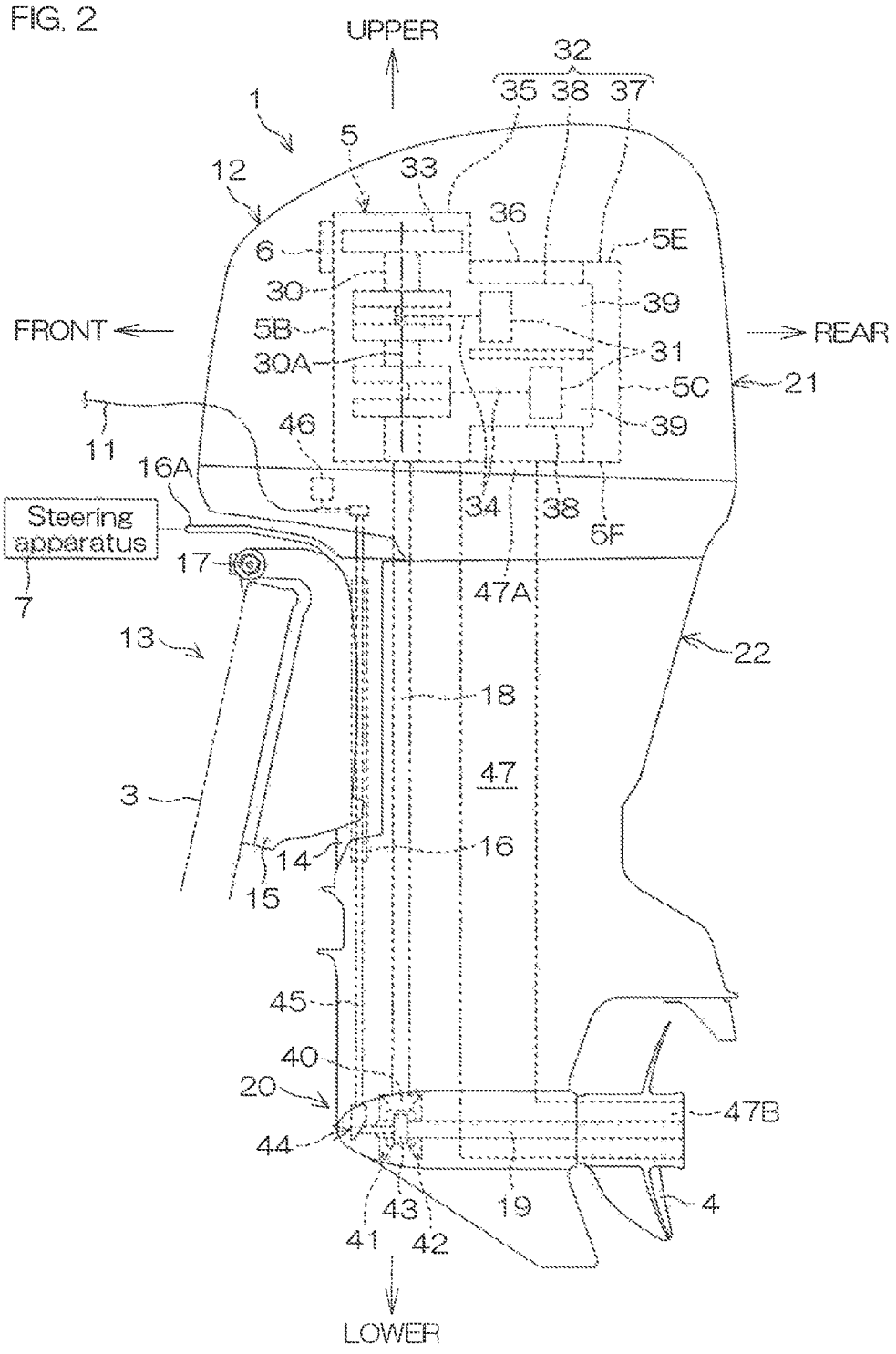
FIG. 2 is a side view of the outboard motor.

FIG. 2 is a left side view of the outboard motor 1. The left side in FIG. 2 is the front side of the outboard motor 1, whereas the right side in FIG. 2 is the rear side of the outboard motor 1. The near side in a direction perpendicular to the sheet of FIG. 2 is the left side of the outboard motor 1, whereas the far side in the direction perpendicular to the sheet of FIG. 2 is the right side of the outboard motor 1.

The outboard motor 1 includes an outboard motor body 12 and an attachment mechanism 13. The attachment mechanism 13 includes a swivel bracket 14, a clamp bracket 15, a steering shaft 16, and a tilt shaft 17. The steering shaft 16 is disposed so as to extend in the up-down direction. The tilt shaft 17 is horizontally disposed so as to extend in the left-right direction. The swivel bracket 14 is connected to the outboard motor body 12 through the steering shaft 16. The clamp bracket 15 is connected to the swivel bracket 14 through the tilt shaft 17. The clamp bracket 15 is fixed to the rear portion of the hull 3. As a result, the outboard motor body 12 is attached to the rear portion of the hull 3 by the attachment mechanism 13 in a perpendicular or substantially perpendicular posture.

The outboard motor body 12 and the swivel bracket 14 are able to turn around the tilt shaft 17 in the up-down direction with respect to the clamp bracket 15. The outboard motor body 12 is turned around the tilt shaft 17, and, as a result, the outboard motor body 12 is tilted with respect to the hull 3 and the clamp bracket 15. The outboard motor body 12 is able to turn together with the steering shaft 16 in the left-right direction with respect to the swivel bracket 14 and the clamp bracket 15. When the vessel operator operates the steering wheel 8, a steering signal is transmitted to the ECU 6. Based on this steering signal, the ECU 6 controls the steering apparatus 7. The driving force of the steering apparatus 7 is transmitted to the steering shaft 16 through the lever 16A. As a result, the outboard motor body 12 turns together with the steering shaft 16 in the left-right direction, and therefore the vessel 2 is steered.

The outboard motor body 12 includes a drive shaft 18, a propeller shaft 19, and a forward-reverse switching mechanism 20. The outboard motor body 12 includes a box-shaped or substantially box-shaped engine cover 21 and a hollow casing 22 that extends downwardly from the engine cover 21. The engine cover 21 and the casing 22 are made of, for example, resin. The engine 5 is covered with the engine cover 21 by being contained in the engine cover 21. The drive shaft 18 extends in the up-down direction inside the engine cover 21 and the casing 22. The propeller shaft 19 extends in the front-rear direction inside the lower portion of the casing 22. A lower end of the drive shaft 18 is connected to a front end of the propeller shaft 19 by the forward-reverse switching mechanism 20. A rear end of the propeller shaft 19 protrudes rearwardly from the casing 22. The propeller 4 is connected to the rear end of the propeller shaft 19. The propeller 4 rotates together with the propeller shaft 19.

The engine 5 is preferably an internal combustion engine that generates power while burning fuel such as gasoline. The engine 5 includes a crankshaft 30, a piston 31, and an engine body 32 that contains these components. The crankshaft 30 has a crankshaft axis 30A that extends in the up-down direction. A lower end of the crankshaft 30 is connected to an upper end of the drive shaft 18. The engine 5 additionally includes a disk-shaped flywheel magneto 33 connected to an upper end of the crankshaft 30. For example, a plurality of pistons 31 are included (in the present preferred embodiment, two pistons are included, for example), and are disposed behind the crankshaft 30. The pistons 31 are arranged in the up-down direction if there are a plurality of pistons, and each piston 31 is connected to the crankshaft 30 through a connecting rod 34. The engine body 32 includes a crankcase 35 that contains the crankshaft 30 and the flywheel magneto 33, cylinders 38 that are disposed behind the crankcase 35 and each of which contains one piston 31, and a cylinder head 37 disposed behind the cylinder 38. The number of the cylinders 38 provided in the present preferred embodiment corresponds to the number of the pistons 31 (herein, two cylinders), and are arranged in the up-down direction. The plurality of cylinders 38 arranged in this way define a cylinder block 36. A combustion chamber 39 is defined by the pistons 31, each cylinder 38, and a cylinder head 37. The piston 31 rectilinearly reciprocates in the front-rear direction perpendicular or substantially perpendicular to the crankshaft axis 30A due to combustion of an air-fuel mixture in the combustion chamber 39. As a result, the crankshaft 30 is rotationally driven around the crankshaft axis 30A.

The forward-reverse switching mechanism 20 includes a driving gear 40, a forward gear 41, a reverse gear 42, a dog clutch 43, and a shift mechanism 44. The driving gear 40, the forward gear 41, and the reverse gear 42 are, for example, cylindrical bevel gears. The driving gear 40 is connected to the lower end of the drive shaft 18. The forward gear 41 and the reverse gear 42 are engaged with the driving gear 40. The forward gear 41 and the reverse gear 42 are disposed so that tooth portions of both gears face each other with a space in the front-rear direction therebetween. The forward gear 41 and the reverse gear 42 each surround the front end of the propeller shaft 19. When the rotation of the driving gear 40 is transmitted to the forward gear 41 and to the reverse gear 42, the forward gear 41 and the reverse gear 42 rotate in mutually opposite directions.

The dog clutch 43 is disposed between the forward gear 41 and the reverse gear 42. The dog clutch 43 is, for example, cylindrical or substantially cylindrical. The dog clutch 43 surrounds the front end of the propeller shaft 19. The dog clutch 43 is connected to the front end of the propeller shaft 19 by, for example, a spline. Therefore, the dog clutch 43 rotates together with the front end of the propeller shaft 19. Additionally, the dog clutch 43 is movable in the axial direction with respect to the front end of the propeller shaft 19. The dog clutch 43 is moved in the axial direction of the propeller shaft 19 by the shift mechanism 44.

The shift mechanism 44 includes a shift rod 45 extending in, for example, the up-down direction and a neutral switch 46. The shift rod 45 is joined to the operation cable 11, and turns around the axis of the shift rod 45 by an operating force input from the operation cable 11. The dog clutch 43 is moved in the axial direction of the propeller shaft 19 by turning of the shift rod 45. The dog clutch 43 is located at any one of a forward position, a reverse position, and a neutral position. The neutral switch 46 detects whether the position of the dog clutch 43 is the neutral position. A detection value of the neutral switch 46 is input into the ECU 6.

The forward position is a position at which the dog clutch 43 engages the forward gear 41, and the reverse position is a position at which the dog clutch 43 engages the reverse gear 42. The neutral position is a position at which the dog clutch 43 engages neither the forward gear 41 nor the reverse gear 42, and is a position between the forward position and the reverse position. In a state in which the dog clutch 43 is located at the forward position, the rotation of the drive shaft 18 is transmitted to the propeller shaft 19 through the forward gear 41, and therefore the shift position of the outboard motor 1 is "forward." In a state in which the dog clutch 43 is located at the reverse position, the rotation of the drive shaft 18 is transmitted to the propeller shaft 19 through the reverse gear 42, and therefore the shift position of the outboard motor 1 is "reverse." In a state in which the dog clutch 43 is located in the neutral position, the rotation of the drive shaft 18 is not transmitted to the propeller shaft 19, and therefore the shift position of the outboard motor 1 is "neutral."

When the rotation of the drive shaft 18 is transmitted to the propeller shaft 19 through the forward gear 41, the propeller 4 rotates in a forward rotational direction. As a result, a propulsive force in the forward direction is generated. When the rotation of the drive shaft 18 is transmitted to the propeller shaft 19 through the reverse gear 42, the propeller 4 rotates in a reverse rotational direction that is opposite to the forward rotational direction. As a result, a propulsive force in the reverse direction is generated. Therefore, switching between the rotational directions of the propeller 4 is performed by switching the positions of the dog clutch 43. Switching between the rotational directions of the propeller 4 is performed by operating the operation lever 9A of the remote controller 9.

The outboard motor body 12 includes an exhaust passage 47 disposed inside the outboard motor body 12. The exhaust passage 47 includes an inlet 47A connected to the engine 5 and an outlet 47B connected to the propeller 4. In a state in which the vessel 2 is floating on water, the outlet 47B is positioned in the water. Therefore, in the state in which the vessel 2 is floating on water, water that has passed through the outlet 47B enters a downstream portion of the exhaust passage 47. For example, when the engine 5 rotates at a high speed, water inside the exhaust passage 47 is pushed by the pressure of exhaust gas sent from the engine 5, and is discharged from the outlet 47B together with the exhaust gas. As a result, the exhaust gas generated in the engine 5 is discharged into the water.

Figure 3:
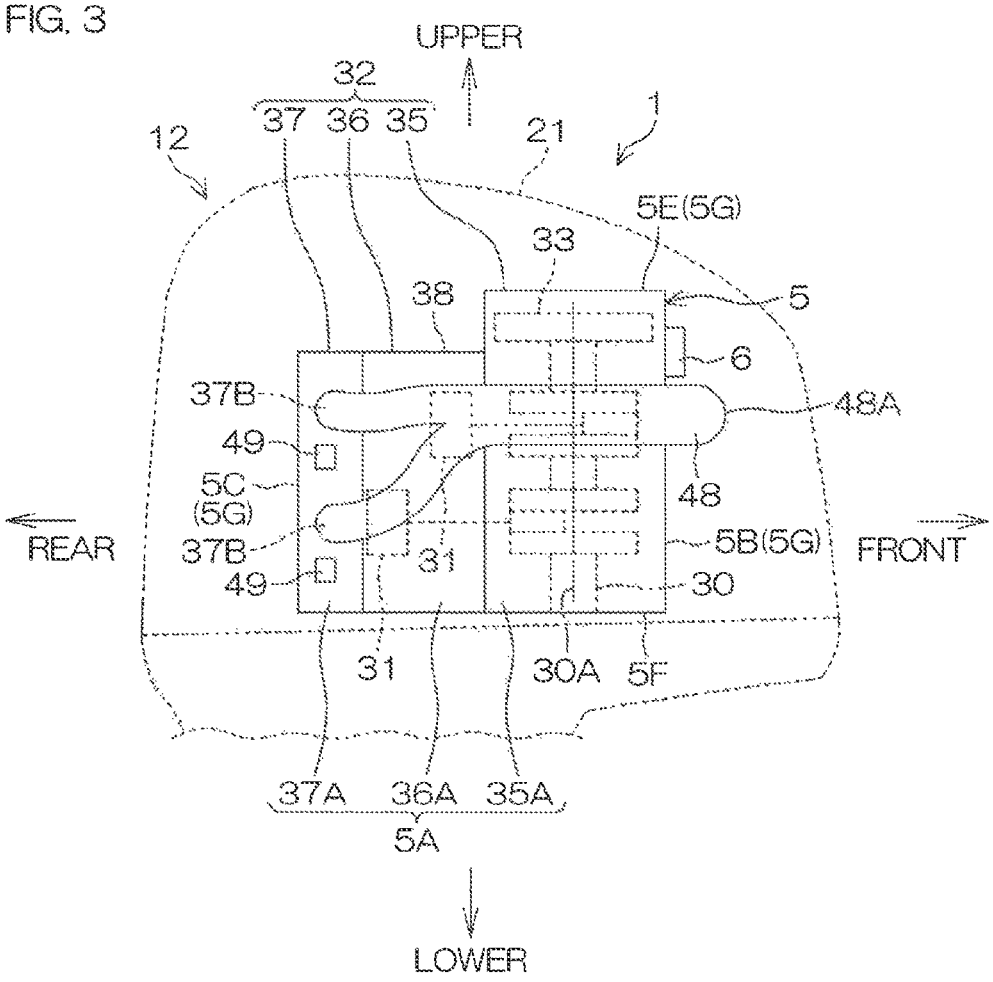
FIG. 3 is a schematic side view of an internal structure of the outboard motor.

FIG. 3 is a schematic right side view of an internal structure of the outboard motor 1. An outer surface of the engine 5 includes at least either of a flat surface and a curved surface. In FIG. 3, a right surface 5A is one example of a first outer surface of the outer surface of the engine 5. The right surface 5A includes a right surface 35A of the crankcase 35, a right surface 36A of the cylinder block 36, and a right surface 37A of the cylinder head 37, and extends in the up-down direction along the crankshaft axis 30A. The right surface 35A, the right surface 36A, and the right surface 37A may be flush with each other, or may deviate from each other in the left-right direction (i.e., a direction perpendicular to the sheet of FIG. 3). The boundary between adjoining surfaces of the right surface 35A, the right surface 36A, and the right surface 37A may be regarded as a portion of the right surface 5A.

An intake port 37B is provided in the right surface 37A of the cylinder head 37. The outboard motor 1 includes an intake pipe 48 that is disposed in the engine cover 21 and that is connected to the intake port 37B. If a plurality of (herein, two) intake ports 37B are provided corresponding to the number of the cylinders 38, the intake pipe 48 is connected to each intake port 37B, and is combined therewith, and extends forwardly. A front end of the intake pipe 48 may be located at a more forward position than the engine body 32. An intake port 48A that is open in the engine cover 21 is provided in the front end of the intake pipe 48. The intake pipe 48 takes in air inside the engine cover 21 through the intake port 48A, and supplies it to each intake port 37B.

The intake pipe 48 is provided with a throttle valve (not shown). A fuel injector 49, which is one example of a fuel supply mechanism, is disposed around the intake port 37B in the right surface 37A. A fuel pipe (not shown) to guide fuel from a fuel tank (not shown) disposed in the hull 3 or a fuel pump (not shown) to supply fuel in the fuel pipe to the fuel injector 49 may be disposed around the fuel injector 49 in the right surface 37A. An air-fuel mixture is generated by mixing fuel jetted by the injector 49 into the intake port 37B and air taken by the intake pipe 48 into each intake port 37B. The air-fuel mixture is supplied from the intake port 37B to the combustion chamber 39 (see FIG. 2) of the engine 5. The opening degree of the throttle valve (not shown) is changed by the operation of the operation lever 9A of the remote controller 9. The ECU 6 adjusts the air-fuel ratio of the air-fuel mixture by controlling the amount of fuel injected from the fuel injector 49 into the intake port 37B in accordance with the opening degree of the throttle valve (not shown). The ECU 6 instructs an ignition coil (not shown) to generate a high voltage. As a result, a high voltage is applied to an ignition plug (not shown), and the ignition plug discharges sparks in the combustion chamber 39. Therefore, the air-fuel mixture burns in the combustion chamber 39 (see FIG. 2).

Figure 4:
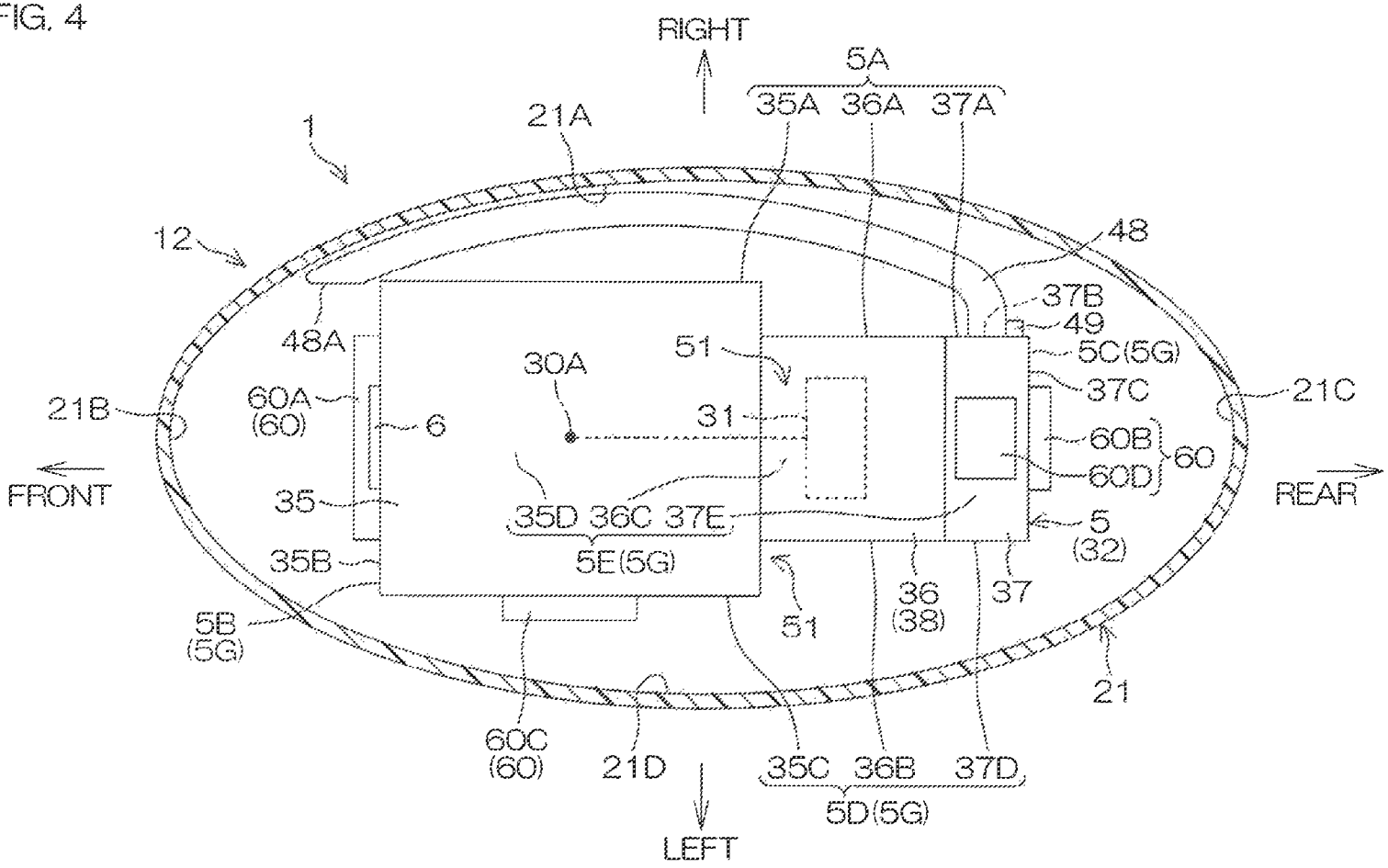
FIG. 4 is a schematic plan view of the internal structure of the outboard motor in a state showing a horizontal section of the engine cover.
Figure 5:
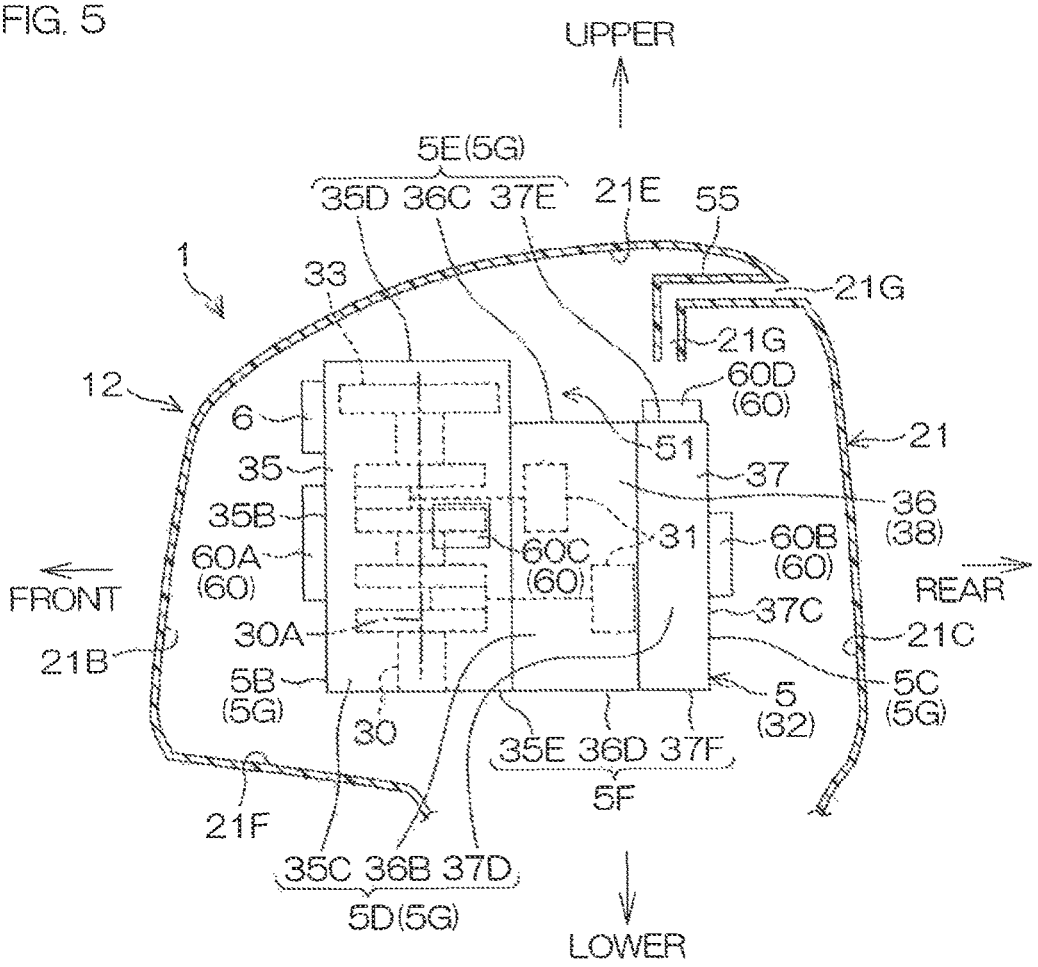
FIG. 5 is a schematic side view of the internal structure of the outboard motor in a state showing a longitudinal section of the engine cover.

FIG. 4 is a schematic plan view of the internal structure of the outboard motor 1 in a state showing a horizontal section of the engine cover 21. FIG. 5 is a schematic left side view of the internal structure of the outboard motor 1 in a state showing a longitudinal section of the engine cover 21. The outer surface of the engine 5 includes a front surface 5B, a rear surface 5C, a left surface 5D, an upper surface 5E, and a lower surface 5F, in addition to the right surface 5A.

The front surface 5B includes a front surface 35B of the crankcase 35. The rear surface 5C includes a rear surface 37C of the cylinder head 37.

The left surface 5D includes a left surface 35C of the crankcase 35, a left surface 36B of the cylinder block 36, and a left surface 37D of the cylinder head 37. The left surface 35C, the left surface 36B, and the left surface 37D may be flush with each other, or may deviate from each other in the left-right direction. The boundary between adjoining surfaces of the left surface 35C, the left surface 36B, and the left surface 37D may be regarded as a portion of the left surface 5D.

The upper surface 5E includes an upper surface 35D of the crankcase 35, an upper surface 36C of the cylinder block 36, and an upper surface 37E of the cylinder head 37. The upper surface 35D, the upper surface 36C, and the upper surface 37E may be flush with each other, or may deviate from each other in the up-down direction. The boundary between adjoining surfaces of the upper surface 35D, the upper surface 36C, and the upper surface 37E may be regarded as a portion of the upper surface 5E.

The lower surface 5F includes a lower surface 35E of the crankcase 35, a lower surface 36D of the cylinder block 36, and a lower surface 37F of the cylinder head 37 (see FIG. 5). The lower surface 35E, the lower surface 36D, and the lower surface 37F may be flush with each other, or may deviate from each other in the up-down direction. The boundary between adjoining surfaces of the lower surface 35E, the lower surface 36D, and the lower surface 37F may be regarded as a portion of the lower surface 5F.

The front surface 5B extends leftwardly from a front end of the right surface 5A. The rear surface 5C extends leftwardly from a rear end of the right surface 5A. The left surface 5D is located such that the engine body 32 is sandwiched between the left surface 5D and the right surface 5A. The upper surface 5E extends leftwardly from an upper end of the right surface 5A. The lower surface 5F extends leftwardly from the upper end of the right surface 5A. Therefore, each of the front surface 5B, the rear surface 5C, the left surface 5D, the upper surface 5E, and the lower surface 5F is located at a position different from the position where right surface 5A is located on the outer surface of the engine 5. Because the right surface 5A is one example of the first outer surface of the outer surface of the engine 5, the front surface 5B, the rear surface 5C, the left surface 5D, and the upper surface 5E are referred to as a second outer surface 5G of the outer surface of the engine 5. The front surface 5B, the rear surface 5C, and the left surface 5D extend along the crankshaft axis 30A. The left surface 5D and the upper surface 5E extend along the front-rear direction that is a direction along which the piston 31 moves.

The horizontal section of the engine cover 21 with which the engine 5 is covered preferably has an annular shape including an elliptical outline longitudinally extending in the front-rear direction (see FIG. 4). An inner surface of the engine cover 21 includes a right inner surface 21A, a front inner surface 21B, a rear inner surface 21C, a left inner surface 21D, an upper inner surface 21E, and a lower inner surface 21F. The right inner surface 21A curves so as to expand rightwardly, and faces the right surface 5A of the engine 5 from the right side with a space between the right inner surface 21A and the right surface 5A. The front inner surface 21B curves so as to expand forwardly, and faces the front surface 5B of the engine 5 from the front side with a space between the front inner surface 21B and the front surface 5B. The rear inner surface 21C curves so as to expand rearwardly, and faces the rear surface 5C of the engine 5 from the rear side with a space between the rear inner surface 21C and the rear surface 5C. The left inner surface 21D curves so as to expand leftwardly, and faces the left surface 5D of the engine 5 from the left side with a space between the left inner surface 21D and the left surface 5D. The upper inner surface 21E curves so as to expand upwardly, and faces the upper surface 5E of the engine 5 from the upper side with a space between the upper inner surface 21E and the upper surface 5E (see FIG. 5). The lower inner surface 21F faces the lower surface 5F from the lower side with a space between the lower inner surface 21F and the lower surface 5F (see FIG. 5).

The engine cover 21 includes an outside-air intake port 21G that takes outside air into the engine cover 21 (see FIG. 5). An air intake duct 55 is provided integrally with the engine cover 21 in relation to the outside-air intake port 21G. Inside the engine cover 21, the air intake duct 55 extends forwardly from the boundary between the upper inner surface 21E and the rear inner surface 21C, and then bends, and extends downwardly toward the upper surface 5E of the engine 5. One example of the outside-air intake port 21G is an internal space of the air intake duct 55, and a rear end of the outside-air intake port 21G is exposed to the outside of the outboard motor 1, and a lower end of the outside-air intake port 21G opposes the upper surface 5E of the engine 5 inside the engine cover 21.

The intake pipe 48 and the fuel injector 49 provided at the right surface 37A of the cylinder head 37, which is a portion of the right surface 5A of the engine 5, are located between the right surface 5A of the engine 5 and the right inner surface 21A of the engine cover 21. The ECU 6 is disposed at the front surface 5B of the engine 5 (see FIG. 5). An auxiliary (not shown), such as a fuse box, is also disposed at the front surface 5B in addition to the ECU 6.

The outboard motor 1 includes a battery 60 that supplies electric power to electrical components, such as the ECU 6. In other words, the outboard motor 1 and the battery 60 are packaged together. This makes it possible to eliminate a battery disposition space in the hull 3. In the outboard motor 1, the number of the batteries 60 may be one or may be two or more. The outboard motor 1 may include a starter motor (not shown) that starts the engine 5 as one example of an electrical component to which electric power is supplied by the battery 60.

The battery 60 is preferably box-shaped or substantially box-shaped. The battery 60 is disposed between the second outer surface 5G (herein, at least any one of the front surface 5B, the rear surface 5C, the left surface 5D, and the upper surface 5E), which is different from the right surface 5A of the outer surface of the engine 5, and the inner surface of the engine cover 21. As a result, the size of the intake pipe 48, the shape thereof, and the disposition thereof that affect the performance of the engine 5 are not restricted by the battery 60. Therefore, it is possible to mount the battery 60 on the outboard motor 1 so that any influence on the performance of the engine 5 is significantly reduced or prevented. The disposition of the battery 60 inside the engine cover 21 makes it possible to fully protect the battery 60 from the influence of the surrounding environment.

In detail, the battery 60 may be disposed between the front surface 5B and the front inner surface 21B of the engine cover 21 (see battery 60A). In this case, auxiliaries, such as the ECU 6 and the fuse box (not shown), are provided at the front surface 5B, and therefore it is possible to provide the battery 60 using a space typically reserved for the auxiliaries. The battery 60 may be disposed between the rear surface 5C and the rear inner surface 21C of the engine cover 21 (see battery 60B).

The battery 60 may be disposed between the left surface 5D and the left inner surface 21D of the engine cover 21 (see battery 60C). The battery 60 may be disposed between the upper surface 5E and the upper inner surface 21E of the engine cover 21 (see battery 60D). The battery 60 disposed between the left surface 5D or the upper surface 5E, along the front-rear direction that is a direction along which the piston 31 moves, and the inner surface of the engine cover 21 does not easily receive vibrations caused by the movement of the piston 31. Therefore, it is possible to prevent the durability of the battery 60 from being reduced due to the vibrations, and it is possible to prevent the connection between the battery 60 and an electrical component, such as the ECU 6, from being broken by the vibrations. Additionally, if the battery 60 is spaced away from the crankshaft axis 30A, it is possible to prevent the battery 60 from receiving vibrations caused by the rotation of the crankshaft 30.

The battery 60 may be disposed between an outer surface of the crankcase 35 (herein, the front surface 35B and the left surface 35C) and the inner surface of the engine cover 21. This makes it possible to prevent the performance of the battery 60 from being reduced by heat generated in the combustion chamber 39 (see FIG. 2) in the cylinder 38 because the battery 60 is spaced away from the cylinder 38. In other words, it is possible to significantly reduce or prevent any influence exerted on the battery 60 from the engine 5. An oil pan (not shown) in which oil that lubricates the engine 5 is gathered is disposed below the engine 5. The oil pan also works as a heat source in the same way as the combustion chamber 39, and therefore it is desirable to locate the battery 60 away from the oil pan and above the oil pan. If the battery 60 has heat-resisting properties, the battery 60 may be disposed adjacent to the cylinder block 36 and adjacent to the oil pan.

The battery 60 disposed between the second outer surface 5G and the inner surface of the engine cover 21 is spaced away from the fuel injector 49 that is located at the right surface 5A. This makes it possible to mount the battery 60 without exerting any influence on the fuel injector 49.

The left surface 36B of the cylinder block 36 and the left surface 37D of the cylinder head 37, each of which is a portion of the left surface 5D, and the upper surface 36C of the cylinder block 36 and the upper surface 37E of the cylinder head 37, each of which is a portion of the upper surface 5E, are disposed at more rearward positions, respectively, than the crankshaft axis 30A. There are instances in which the crankcase 35 containing the crankshaft 30 is bulkier than the cylinder block 36 and the cylinder head 37. In this case, a level difference 51 (a different in the level) between the crankcase 35 and the cylinder block 36 is created at a more rearward position than the crankshaft axis 30A in the engine body 32. The level difference 51 is a space between the left surface 35C of the crankcase 35 and the left surface 36B, and extends to the left surface 37D. Another level difference 51 extends to the upper surface 37E from between the upper surface 35D of the crankcase 35 and the upper surface 36C (see FIG. 5). If the battery 60 is disposed between the left surface 37D or the upper surface 37E and the inner surface of the engine cover 21, the battery 60 will be located and contained in either one of the level differences 51. This makes it possible to significantly reduce or prevent the shape of the engine cover 21 from being restricted by the battery 60. Therefore, it is possible to provide the engine cover 21 with an arbitrary design, such as a streamline shape (see FIG. 4) to reduce air resistance. The level difference 51 in the upper surface 5E is a space that contains a lower end of the air intake duct 55. The battery 60 disposed between the upper surface 37E and the inner surface of the engine cover 21 is disposed so as to effectively use this space (see battery 60D of FIG. 5).

The battery 60 may be disposed at the second outer surface 5G as shown in FIG. 4 and FIG. 5. As a result, the battery 60 is fixed to the engine 5, and therefore the position of the battery 60 is stabilized.

If the battery 60 is disposed at the upper surface 5E of the engine 5, the battery 60 (see battery 60D) is disposed directly under the lower end of the outside-air intake port 21G, and faces the lower end of the outside-air intake port 21G from below (see FIG. 5). This makes it possible to cool the battery 60 with outside air taken in from the outside-air intake port 21G. Therefore, it is possible to significantly reduce or prevent an increase in temperature of the battery 60, and is possible to keep the temperature of the battery 60 at a suitable temperature of, for example, about 20 degrees. Therefore, it is possible to significantly reduce or prevent a reduction in the performance of the battery 60 resulting from an increase in temperature. Particularly, if the battery 60 is disposed directly under the outside-air intake port 21G, it is possible to directly blow outside air onto the battery 60. Therefore, it is possible to facilitate the cooling of the battery 60 with the outside air, and therefore it is possible to further reduce or prevent a reduction in the performance of the battery 60 resulting from an increase in temperature. The battery 60 may have a function to rectify air that has been taken from the outside-air intake port 21G into the engine cover 21 or a function to direct and guide air toward the intake port 48A of the intake pipe 48.

Figure 6:
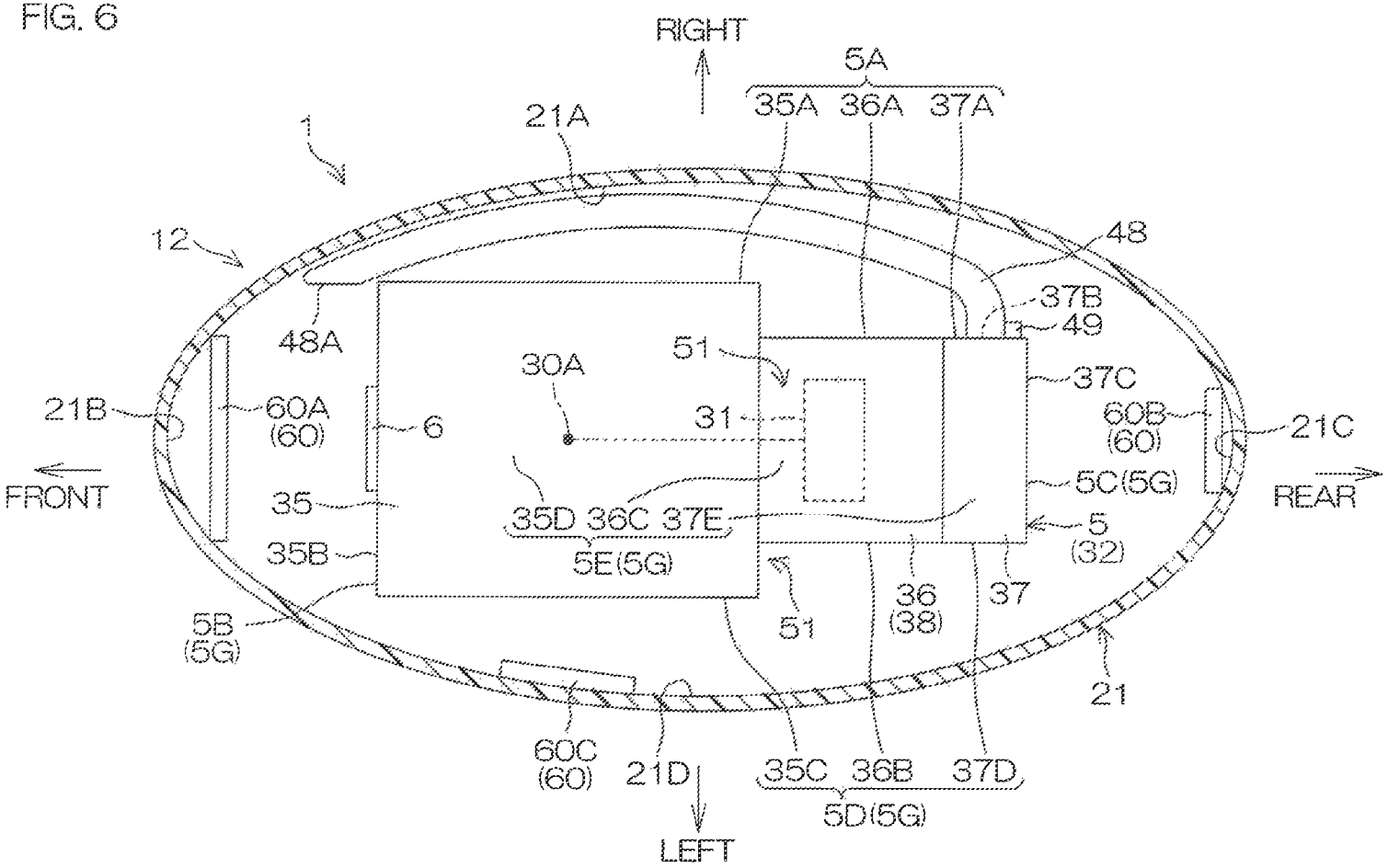
FIG. 6 is a schematic plan view of an internal structure of an outboard motor according to another preferred embodiment of the present invention in a state showing a horizontal section of an engine cover.
Figure 7:
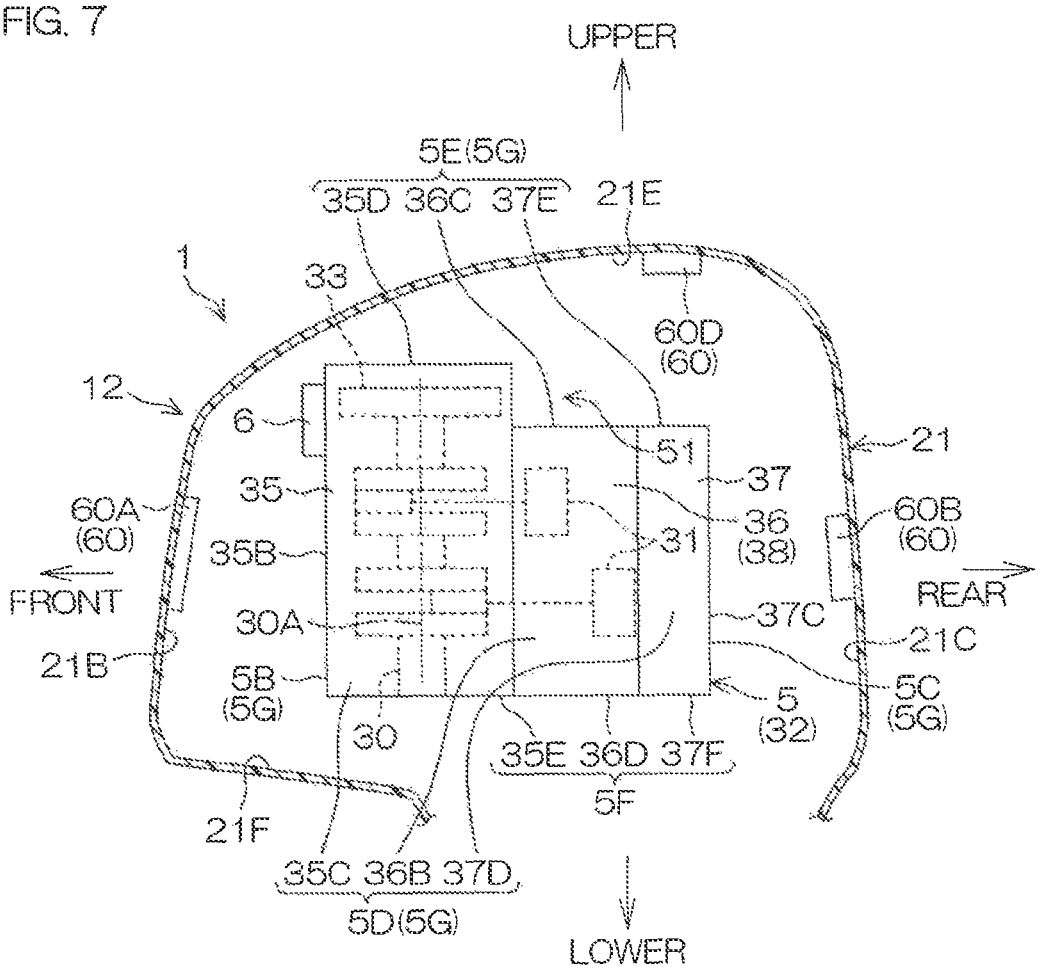
FIG. 7 is a schematic side view of the internal structure of the outboard motor in a state showing a longitudinal section of the engine cover.

As shown in FIG. 6 and FIG. 7, the battery 60 may be disposed at an inner surface of the engine cover 21 (herein, at least any one of the front inner surface 21B, the rear inner surface 21C, the left inner surface 21D, and the upper inner surface 21E) that faces the second outer surface 5G. This makes it possible to further reduce or prevent any influence exerted by the battery 60 on the engine 5 because the battery 60 is spaced away from the engine 5. Additionally, it becomes difficult for vibrations of the engine 5 to be transmitted to the battery 60. This makes it possible to significantly reduce or prevent the durability of the battery 60 from being reduced by the vibrations, and makes it possible to significantly reduce or prevent the connection between the battery 60 and an electrical component, such as the ECU 6, from being broken by the vibrations. The outside-air intake port 21G (not shown in FIG. 6 and FIG. 7) may face the battery 60 located on the engine cover 21.

Figure 8:
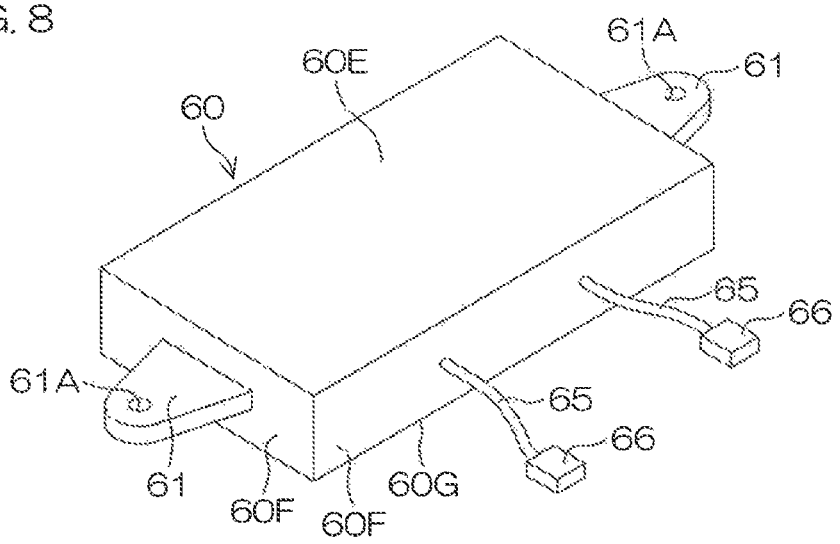
FIG. 8 is a perspective view of a battery disposed in the outboard motor.

FIG. 8 is a perspective view of the battery 60. An outer surface of the battery 60 is preferably box-shaped or substantially box-shaped and includes a substantially rectangular installation surface 60E that has four sides, four side surfaces 60F continuous with an edge of the installation surface 60E, and a substantially rectangular opposite surface 60G disposed opposite to the installation surface 60E. The battery 60 is preferably thin in a direction in which the installation surface 60E and the opposite surface 60G are spaced apart. Therefore, each side surface 60F preferably has a slender rectangular shape and extends along a corresponding side of the installation surface 60E. A plurality of (in the present preferred embodiment, two) lead wires 65 extend from, for example, the side surface 60F, and a connector 66 provided at a front end of the lead wire 65 is connected to an electrical component described above. The installation surface 60E is wider than the other outer surfaces (at least the side surface 60F) of the battery 60. The installation surface 60E may have the same size as the opposite surface 60G although it is preferable for the installation surface 60E to have a larger size than the opposite surface 60G. For example, each of the two side surfaces 60F that face each other with the installation surface 60E therebetween is provided with a mount 61. Alternatively, all of the four side surfaces 60F may be provided with a mount 61, respectively. The mount 61 preferably has the shape of a plate and is disposed so that a thickness of the plate extends in the same direction as the thinness of the battery 60, and projects from the side surface 60F. A through hole 61A that passes through the mount 61 in the plate-thickness direction is provided in the mount 61.

Figure 9:
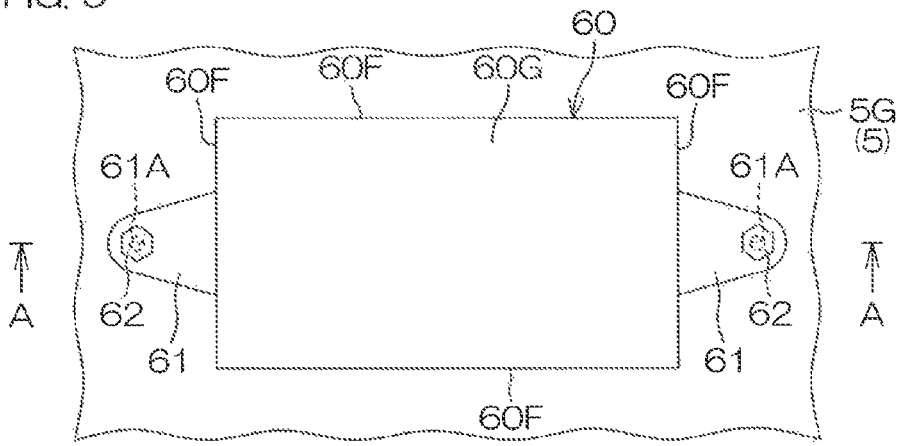
FIG. 9 is a side view of the battery in a state of having been attached to the engine.
Figure 10:
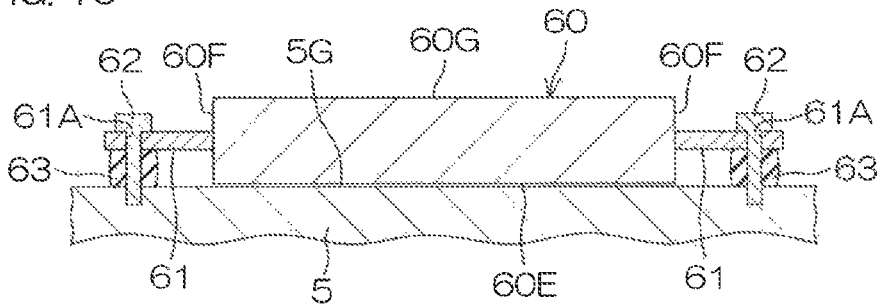
FIG. 10 is a cross-sectional view along line A-A in FIG. 9.

FIG. 9 is a side view of the battery 60 seen from the outside in a state in which the battery 60 has been attached to the second outer surface 5G of the engine 5. FIG. 10 is a cross-sectional view along line A-A in FIG. 9. In a state in which the installation surface 60E of the battery 60 faces the second outer surface 5G, a bolt 62 that is one example of a fastener is fastened to the engine 5 through the through hole 61A of each mount 61. As a result, the battery 60 located on the second outer surface 5G is attached to the engine 5. In this state, the installation surface 60E extends along the second outer surface 5G, and therefore the position of the battery 60 is stabilized. Particularly, in a state in which the installation surface 60E, which is wider than the other outer surfaces of the battery 60, extends along the second outer surface 5G, the battery 60 is attached to the engine 5 by the mounts 61. Therefore, the battery 60 is attachable thereto in a manner in which an influence exerted on the engine 5 is significantly reduced or prevented, and the position of the battery 60 becomes even more stable.

The battery 60 may be disposed in a floating state spaced apart from the second outer surface 5G by a gap provided between the installation surface 60E and the second outer surface 5G. This makes it possible to significantly reduce or prevent the heat of the engine 5 from being transmitted to the battery 60. An elastic support 63 made of an elastic material, such as rubber, is disposed between each mount 61 and the second outer surface 5G. The elastic support 63 is cylindrical or substantially cylindrical, and a bolt 62, for example, is fastened to the engine 5 while passing through the elastic support 63. The battery 60 spaced apart from the second outer surface 5G is elastically supported by the elastic supports 63.

Other Preferred Embodiments

Although preferred embodiments of the present invention have been described above, the present invention is not restricted to the contents of the preferred embodiments described above and various modifications are possible within the scope of the present invention.

Figure 11:
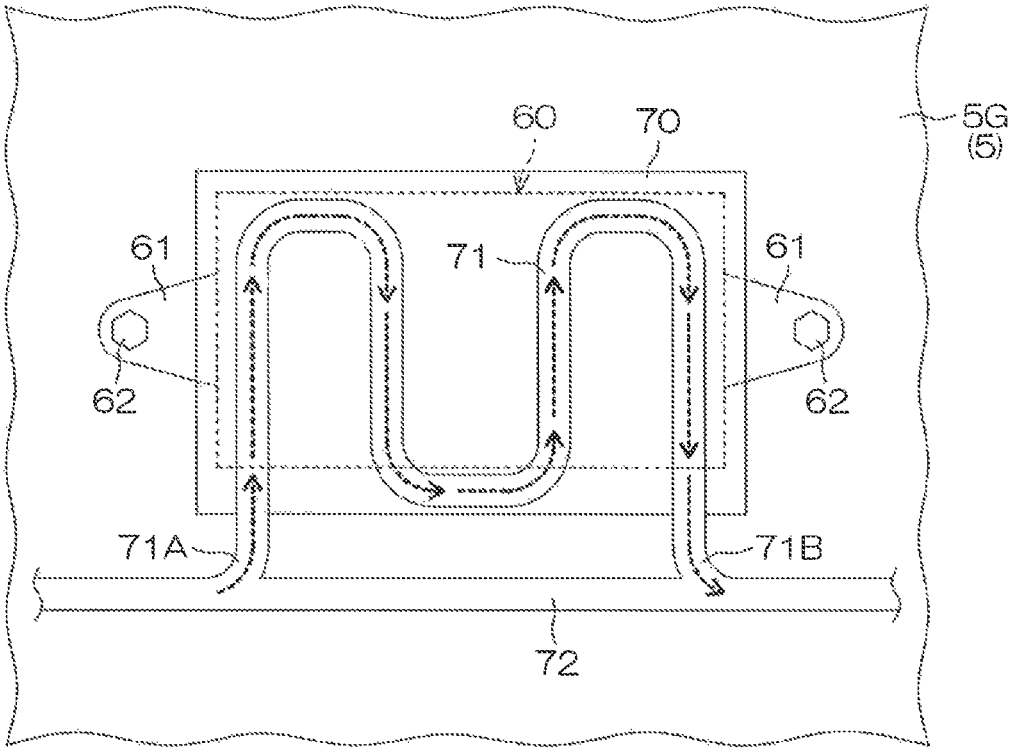
FIG. 11 is a side view of a battery according to another preferred embodiment of the present invention in a state of having been attached to an engine.
Figure 12:
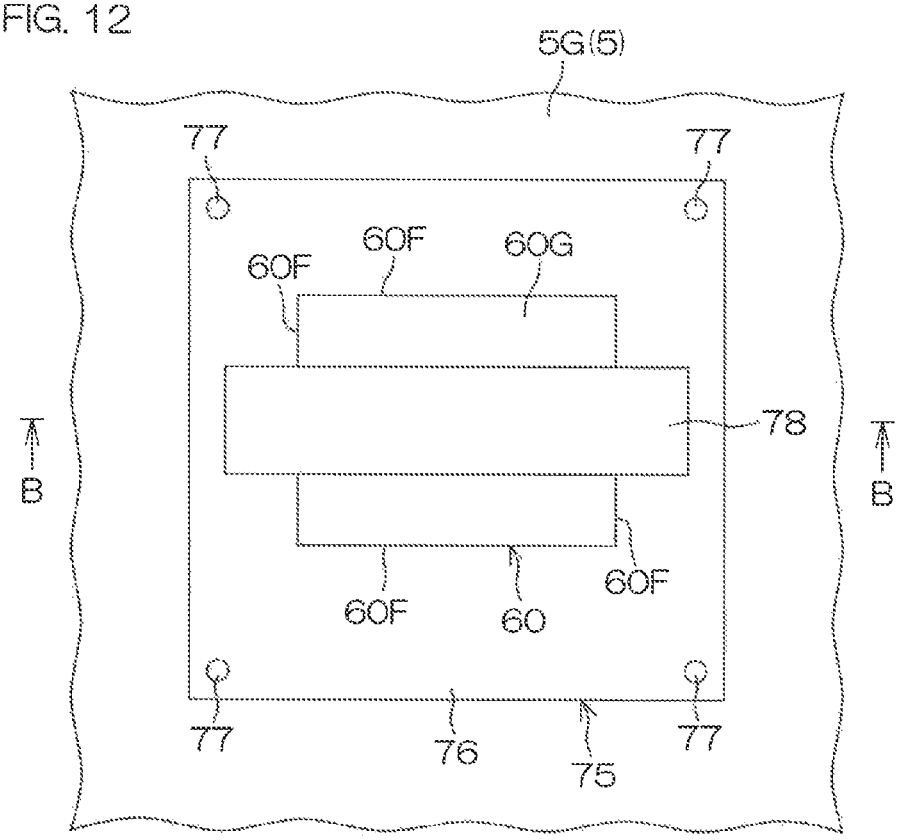
FIG. 12 is a side view of a battery according to another preferred embodiment of the present invention in a state of having been attached to an engine.
Figure 13:
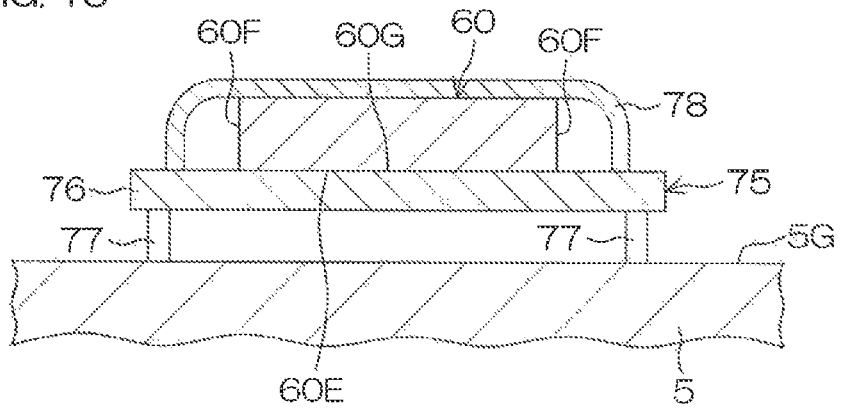
FIG. 13 is a cross-sectional view along line B-B in FIG. 12.

FIG. 11 is a side view of a battery 60 seen from the outside according to another preferred embodiment of the present invention in a state of having been attached to an engine 5. FIG. 12 is a side view of a battery 60 seen from the outside according to another preferred embodiment of the present invention in a state of having been attached to an engine 5. FIG. 13 is a cross-sectional view along line B-B in FIG. 12. In FIGS. 11, 12, and 13, the same reference numeral is given to an element equivalent to each element described above, and a description of the element is omitted.

In the preferred embodiment shown in FIG. 11, the outboard motor 1 includes a battery cover 70 with which the battery 60 is covered. The battery cover 70 may be used with either the battery 60 disposed on the engine 5 or the battery 60 disposed on the engine cover 21. The battery cover 70 is fixed to the battery 60. The battery cover 70 is provided with a first flow passage 71 made of a pipe or the like. The first flow passage 71 is disposed along an outer surface of the battery 60 (for example, the opposite surface 60G). The first flow passage 71 may be curved so as to meander. Cooling water flows through the first flow passage 71.

In relation to the first flow passage 71, the outboard motor 1 includes a second flow passage 72 through which cooling water to cool the engine 5 flows. The first flow passage 71 includes an upstream end 71A and a downstream end 71B, and branches from the second flow passage 72 in the upstream end 71A, and joins the second flow passage 72 in the downstream end 71B. A portion of the cooling water flowing through the second flow passage 72 flows into the first flow passage 71 from the upstream end 71A, and cools the battery 60, and returns from the downstream end 71B to the second flow passage 72 (see the dashed arrow). This makes it possible to cool the battery 60 with the cooling water flowing through the first flow passage 71, and hence makes it possible to significantly reduce or prevent a reduction in the performance of the battery 60 resulting from an increase in temperature. Additionally, the cooling of the battery 60 makes it possible to avoid heat stagnation around the engine 5 caused by the battery 60, and hence makes it possible to reduce any influence exerted by the battery 60 on the engine 5. Particularly, it is possible to cool the battery 60 by using cooling water by which the engine 5 is cooled. Therefore, it is possible to make the arrangement simpler than in a case in which exclusive cooling water to cool the battery 60 is provided, and hence it is possible to reduce costs.

In the preferred embodiment shown in FIG. 12 and FIG. 13, the outboard motor 1 includes a support structure 75 to support the battery 60 in a floating state spaced apart from the second outer surface 5G. The support structure 75 includes a base 76 preferably have the shape of a substantially rectangular plate, a connector 77 that is provided, for example, at each of the four corners of the base 76 and that is connected to the second outer surface 5G, and a belt-shaped holder 78 provided such that the battery 60 is sandwiched between the base 76 and the holder 78. The base 76 is made of, for example, resin. The connector 77 is made of an elastic material such as rubber, and the base 76 is elastically supported by the connector 77 in a floating state spaced apart from the second outer surface 5G. Therefore, the battery 60 fixed to the base 76 by the holder 78 is also elastically supported in a floating state spaced apart from the second outer surface 5G.

The outboard motor 1 may be a hybrid type outboard motor that includes a built-in electric motor (not shown) and that rotates the propeller 4 by output from the engine 5 and the electric motor, although the propeller 4 may be rotated only by the engine 5. In this case, the electric power of the battery 60 is also supplied to the electric motor.

The battery 60 may not only supply electric power to electrical components included in the outboard motor 1 but also be used as a preliminary power source in the vessel 2.

Another battery may be mounted on the hull 3 in addition to the battery 60 mounted on the outboard motor 1.

It is to be understood that features of two or more of the various preferred embodiments described above may be combined.

The present application claims priority to Japanese Patent Application No. 2016-162200 filed on Aug. 22, 2016 in the Japan Patent Office, and the entire disclosure of which is incorporated herein by reference in its entirety.

While preferred embodiments of the present invention have been described above, it is to be understood that variations and modifications will be apparent to those skilled in the art without departing from the scope and spirit of the present invention. The scope of the present invention, thus, is to be determined solely by the following claims.

What is claimed is:

1. An outboard motor comprising:

an engine including a piston that reciprocates rectilinearly and a crankshaft that rotates around a crankshaft axis extending in an up-down direction;

an engine cover that covers the engine;

an intake pipe disposed between an outer surface of the engine and an inner surface of the engine cover and connected to a first outer surface of the engine along the crankshaft axis to supply air to the engine; and a battery disposed between a second outer surface of the engine, which is different from the first outer surface, and the inner surface of the engine cover.

2. The outboard motor according to claim 1, wherein the second outer surface extends along the crankshaft axis.

3. The outboard motor according to claim 2, wherein the engine includes an engine body including a cylinder containing the piston and a crankcase containing the crankshaft; and the second outer surface is disposed on a surface of the crankcase.

4. The outboard motor according to claim 3, wherein the second outer surface is located such that the engine body is between the first outer surface and the second outer surface.

5. The outboard motor according to claim 1, wherein the second outer surface is located at a more rearward position than the crankshaft axis.

6. The outboard motor according to claim 1, wherein the second outer surface extends along a direction along which the piston reciprocates.

7. The outboard motor according to claim 6, wherein the engine includes a cylinder head to which the intake pipe is connected; and the second outer surface includes an upper surface of the cylinder head.

8. The outboard motor according to claim 1, further comprising a fuel supply disposed between the outer surface of the engine and the inner surface of the engine cover and that supplies fuel to the engine; wherein the battery is spaced apart from the fuel supply.

9. The outboard motor according to claim 1, wherein the battery is located on the inner surface of the engine cover that faces the second outer surface.

10. The outboard motor according to claim 1, wherein the battery is located on the second outer surface.

11. The outboard motor according to claim 10, wherein the battery includes an installation surface that faces the second outer surface and extends along the second outer surface.

12. The outboard motor according to claim 11, wherein the battery is a box-shaped or substantially box-shaped; and the installation surface is one outer surface of the box-shaped battery, and is wider than other outer surfaces of the battery.

13. The outboard motor according to claim 12, wherein the battery includes a mount disposed on an outer surface of the battery that is continuous with an edge of the installation surface to mount the battery on the engine.

14. The outboard motor according to claim 1, further comprising a battery cover that covers the battery and includes a first flow passage through which cooling water flows.

15. The outboard motor according to claim 14, further comprising a second flow passage through which cooling water that is used to cool the engine flows; wherein the first flow passage branches from the second flow passage.

16. The outboard motor according to claim 1, wherein the engine cover includes an outside-air intake port to take in outside air; and the battery faces the outside-air intake port.

17. The outboard motor according to claim 16, wherein the battery is disposed directly under the outside-air intake port.

18. The outboard motor according to claim 1, wherein the engine includes a plurality of cylinders arranged in the up-down direction.

* * * * *